US005361571A

United States Patent [19]

Joyce

[11] Patent Number: 5,361,571

[45] Date of Patent: Nov. 8, 1994

[54] MAGNETIC POT STABILIZER

[76] Inventor: Michael F. Joyce, 132 Vaughn St., Eden, N.C. 27288

[21] Appl. No.: 84,444

[22] Filed: Jul. 1, 1993

Related U.S. Application Data

[63] Continuation of Ser. No. 751,540, Aug. 29, 1991, abandoned.

[51] Int. Cl.[5] ..... D01H 7/86

[52] U.S. Cl. ..... 57/58.76

[58] Field of Search ..... 57/58.72, 58.76, 58.49

[56] References Cited

U.S. PATENT DOCUMENTS

| | | | |
|---|---|---|---|
| 2,374,085 | 4/1945 | Gwaltney et al. | 57/58.76 |
| 2,640,310 | 6/1953 | Roberts | 57/58.76 |
| 2,664,694 | 1/1954 | Gannon et al. | 57/58.76 |
| 2,684,566 | 7/1954 | Roberts | 57/58.76 |
| 2,785,526 | 3/1957 | Keith | 57/58.76 |
| 3,153,894 | 10/1964 | Kreuschmer | 57/58.76 |
| 3,177,643 | 4/1965 | De Holleux et al. | 57/58.76 |
| 3,323,299 | 6/1967 | Heimes | 57/58.72 |
| 3,338,043 | 8/1967 | Franzen | 57/58.76 |
| 3,343,359 | 9/1967 | Franzen et al. | 57/58.76 |
| 3,406,511 | 10/1968 | Nimtz et al. | 57/58.76 |
| 3,456,432 | 7/1969 | Nimtz et al. | 57/58.76 |
| 3,648,449 | 3/1972 | Greive | 57/58.76 |
| 4,261,164 | 4/1981 | Tardy | 57/58.76 |

FOREIGN PATENT DOCUMENTS

| | | |
|---|---|---|
| 571487 | 10/1958 | Belgium . |
| 1012225 | 7/1957 | Germany . |

*Primary Examiner*—Daniel P. Stodola
*Assistant Examiner*—Michael R. Mansen
*Attorney, Agent, or Firm*—Richard C. Litman

[57] ABSTRACT

A magnetic pot stabilizer for multiple twist spindles, includes a protective pot supported by a portion of a rotatable spindle and supporting one or more spools of thread. The pot includes an internal circumferential trough around the perimeter of the bottom surface, and a generally planer circular magnet belt which has a central opening for passage of the spindle therethru and an extended portion carrying spaced pins depending into the trough for separating and locating magnets carried in the trough. Two L-shaped brackets located outside of the pot and curcumferentially spaced around the pot adjustably carry magnet holders each having a plurality of magnets mounted therein which cooperate and coact with the magnets inside the pot to prevent the port from moving when the spindle rotates.

16 Claims, 2 Drawing Sheets

26
22
12
22
28
20
18
42
10
16
24
70
2
13
44
50
58
60
2
52
64
14
48
62
15
40
54
32
30
66
64
33
34
36
56

MAGNETIC POT STABILIZER

CROSS-REFERENCE TO RELATED APPLICATION

This is a continuation of Ser. No. 07/751,540 filed Aug. 29, 1991, now abandoned.

BACKGROUND OF THE INVENTION

1. Field of the Invention

This invention relates to a stabilizer for the pot of a multiple-twist spindle including magnetic means for holding the pot stationary while the spindle rotates. The use of magnetic locking means has enabled the change of the top part of the spindle from a plurality of mechanical parts, which in the past acted as a locking system to stabilize or prevent the pot from turning, to a solid part, resulting in a savings in parts usage and cost.

2. Description of the Related Prior Art

The use of magnets to effect braking of rotatable parts in double twisting machines is known in the prior art. U.S. Pat. No. 3,153,894, issued Oct. 27, 1964 to Rudolph Kreuschmer, discloses a double twisting machine comprising a stationary cylinder that carries a magnet embedded in a sidewall near the base thereof, and a cooperating spool head cylinder having a second magnet embedded in a base portion whereby the spool is prevented from rotating with the spindle.

U.S. Pat. No. 3,177,643, issued Apr. 13, 1965 to Pierre de Halleux et al, discloses a magazine wall carrying a steel member which cooperates with a magnet fixed on an anti-ballooning casing to prevent the magazine from rotating with a double-twist spindle.

U.S. Pat. No. 3,264,813, issued Aug. 9, 1966 to John K. P. Mackie, discloses a two-for-one twisting or spinning machine having a magnet mounted on a bracket carrying take-up rollers which cooperates with a magnet secured to a machine frame outside the balloon path to prevent the take-up rollers from rotating with a flyer on the machine.

Similarly, U.S. Pat. No. 3,338,043, issued Aug. 29, 1967 to Gustav Franzen, U.S. Pat. No. 3,343,359, issued Sep. 26, 1967 to Gustav Franzen et al., U.S. Pat. No. 3,406,311, issued Oct. 22, 1968 to Klaus Nimtz et al., U.S. Pat. No. 3,456,432, issued Jul. 22, 1969 to Klaus Nimtz et al., U.S. Pat. No. 3,648,449, issued Mar. 14, 1972 to Aloys Greive, Belgium Patent No. 371,487 to Volkmann and Co., published Oct. 15, 1958 and German Patent No. 1,012,225 to Barmer Maschinenfabrik Aktiengesellschaft, Wuppertal-Oberbarmen, published Jul. 11, 1957, all teach the use of magnets to prevent rotation of a spool with a rotating spindle in double-twist machines.

SUMMARY AND OBJECTS OF THE INVENTION

It is an object of this invention to provide a magnetic pot stabilizer of simple construction which uses fewer parts and which is easier to maintain.

It is a further object of this invention to provide a new and novel way of adjustably mounting and retaining one or more magnets within a pot in combination with a multiple-twist spindle.

These and other objects are obtained by providing a magnet belt or holder at the base of a pot, said belt or holder having separator pins depending therefrom, whereby magnets may be located in a trough within said pot base when said belt or holder is placed over said magnets, said magnets being aligned with other magnets located outside of said pot attached to a surface or frame of a twisting machine, the magnets serving to stop rotation of the pot while allowing the spindle to continue to rotate to thereby twist the thread or the like. Magnetic braking also allows for the simplification of the spindle structure.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
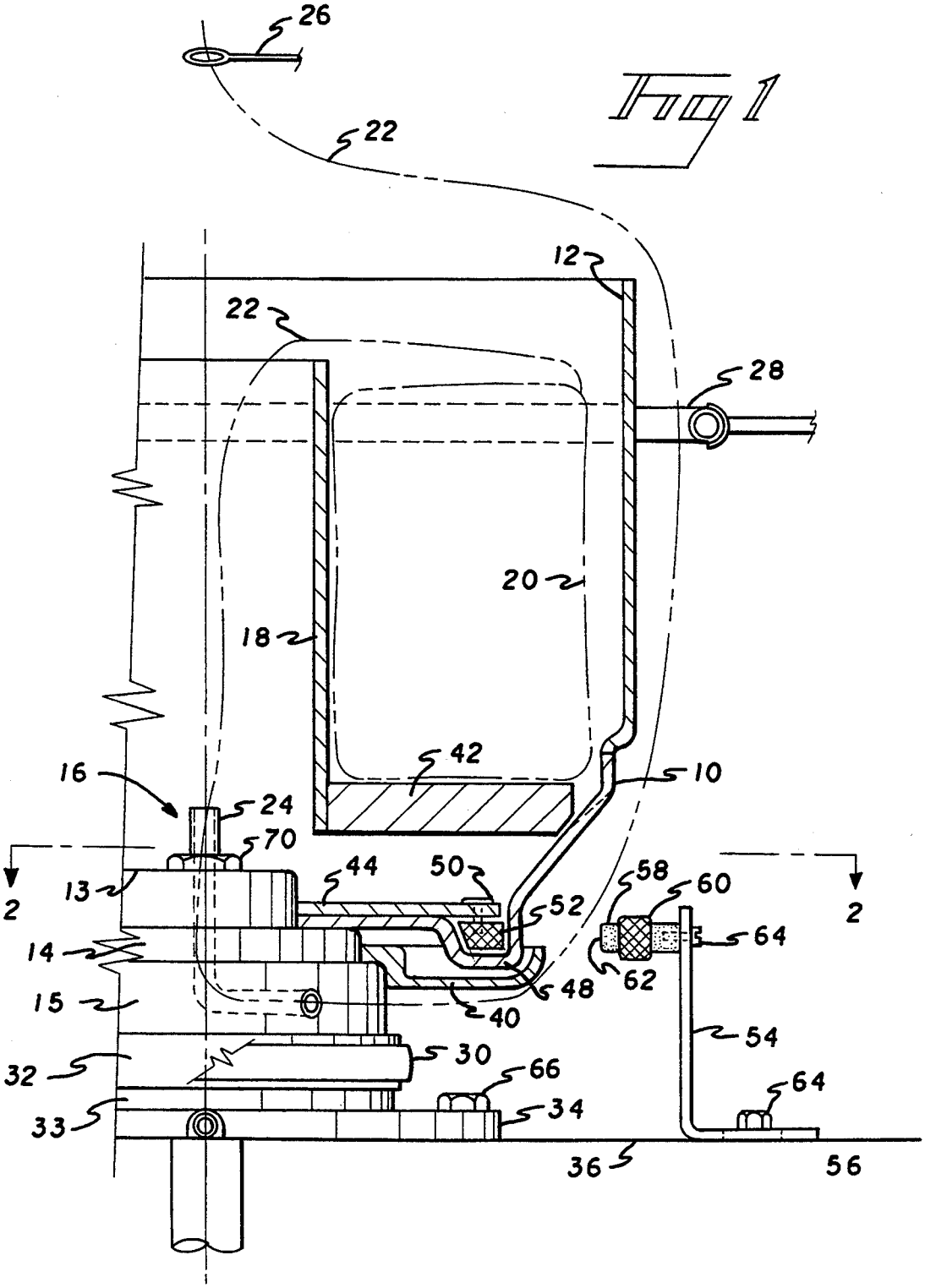
FIG. 1 is a sectional front view showing the relationship between the several parts of the magnetic pot stabilizer.

In FIG. 1, base 10 of pot 12, provided to protect spindle 16, is shown to rest on a portion 14 of a rotatable spindle 16. Without a braking mechanism of some sort, pot 12 would rotate with spindle 16 due to frictional engagement therebetween. Pot 12 is provided with a hollow support shaft 18, which supports one or more spools 20 of thread 22, the number of spools depending upon whether the spools are take-up or supply spools. For purposes of illustration only, spool 20 has been deemed to be a supply spool. Thread 22, when pulled off the spool 20 by means not shown but well known in the prior art, is directed into hollow support shaft 18, and from there into a small pipe 24 which is integral with rotatable spindle 16. When spindle 16 rotates, thread 22 exists from the bottom end of pipe 24. Thread 22 tends to balloon out as shown in the right side of FIG. 1 as thread 22 is pulled through eyelet guide 26 by conventional take-up means, not shown. Surrounding pot 12 is a balloon ring 28, the purpose of which is to limit and control the degree of ballooning by thread 22.

Spindle 16 is rotated by means of a conventional drive belt 30 driven by a conventional motor not shown, the belt 30 riding on a conventional drive pulley portion 32 of spindle 16. The supporting frame 34 for spindle 16 is fixedly mounted on a surface 36 by bolts 66. Also mounted on spindle 16 is a guide 40 for thread 22 when thread 22 exits the bottoms end of pipe 24.

As shown in FIG. 1, hollow support shaft 18 includes a bottom flange 42 which rests upon the base 10 of pot 12, and which provides support for spool or spools 20. If thread 22 is to be properly twisted during rotation of spindle 16, a spool 20 and pot 12 must remain stationary. As shown in FIG. 1, a magnet belt or guide 44 rests on and in frictional engagement with base 10 of pot 12. A portion 46 of magnet belt or guide 44 extends over a circular trough 48 provided around the outer perimeter of base 10 of pot 12. Portion 46 includes a plurality of spaced pins or separators 50 which extend down into trough 48 to locate and separate magnets 52 which are configured to rest in trough 48 between pins or separators 50.

Figure 2:
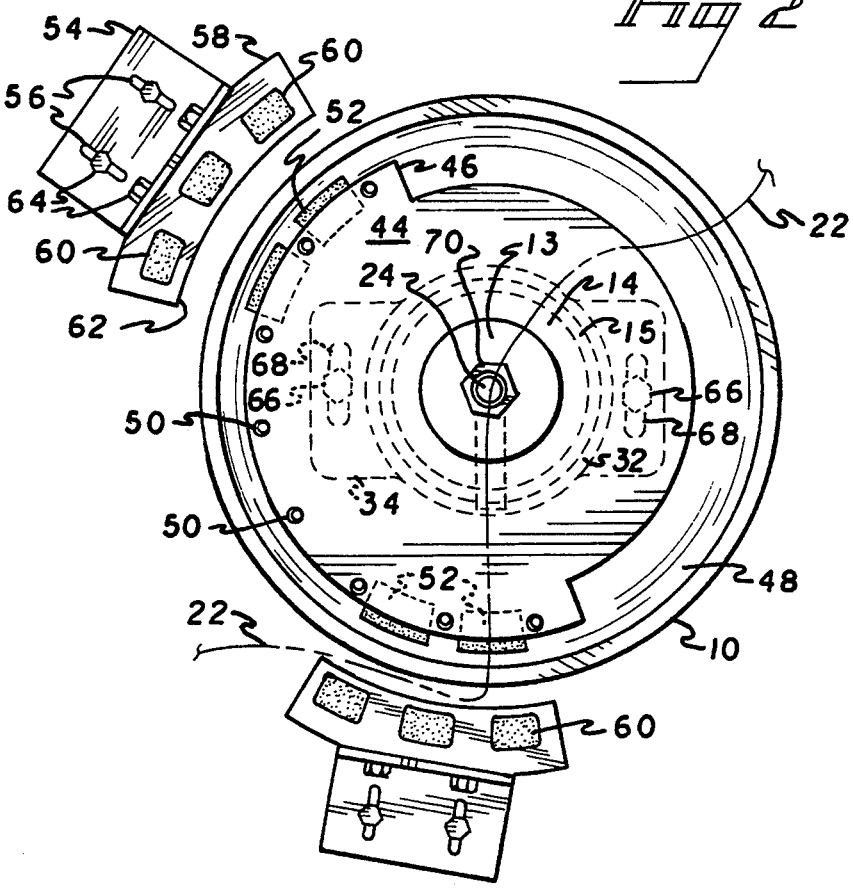
FIG. 2 is a top sectional view taken along line 2—2 in FIG. 1.

Adjustably mounted on surface 36 outside of base 10 of pot 12 is an L-shaped bracket 54 having slots 56 therein which enable both horizontal adjustment of the bracket 54 and vertical adjustment of a magnet holder 58 relative to base 10 of pot 12, to thereby align the magnets 60 carried by holder 58 with magnets 52 in trough 48. One edge 62 of holder 58 is configured to conform with the circular configuration of base 10 of pot 12, and is spaced sufficiently far to allow thread 22 to pass between holder 58 and base 10 as spindle 16 rotates, yet close enough to magnets 52 to allow the magnetic force between magnets 52 and 60 to prevent rotation of belt or guide 44 and, because of frictional engagement, pot 12. As shown in FIGS. 1 and 2, bolts 64 in slots 56 enable the horizontal and vertical adjustment.

By providing a magnetic locking means to prevent rotation of pot 12 with spindle 16, the top portion of spindle 16 no longer requires an integral locking structure and accordingly can be made solid with fewer parts. Spindle 16 is integrally formed of solid cylindrical portions 13, 14, 15, 32 and 33 having different diameters. The cylindrical portions may be machined for example from a solid unitary block, with a bore being provided for pipe 24, as shown in FIGS. 1 and 2. As shown in FIG. 1 and described above cylindrical portion 14 supports base 10 of pot 12, cylindrical portion 15 supports guide 40, and cylindrical portion 32 provides the drive pulley for conventional drive belt 30.

FIG. 2 is a top sectional view of the device showing the circumferential placement of magnets 52 and 60 and also shows the means for mounting supporting frame 34 including bolts 66 engageable in slots 68. Nut 70 serves the purpose of locating pipe 24 on spindle 16.

Figure 3:
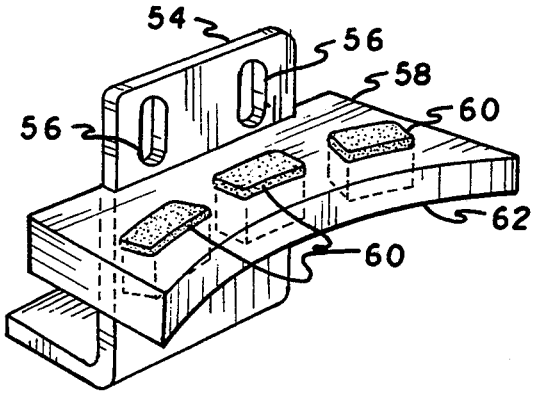
FIG. 3 is a perspective view of the outside magnet support.

FIG. 3 shows that holder 58 is adjustable relative to bracket 54 and may be slid up and down vertically before the introduction of bolts 64 into slots 56.

It should be noted that the top portion of pot 12 is separable from base 10 as is conventional in the prior art.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A magnetic pot stabilizer for multiple twist spindles, comprising:

a rotatable spindle having a unitary construction with integral portions having different diameters, wherein said spindle further includes an integral pot supporting portion, a pot engaging portion having a diameter less than the diameter of said integral pot support portion, and an integral drive pulley portion;

a spindle protecting pot having an interior region defined by an upper portion connected to a base portion, wherein said base portion rests directly on said integral pot supporting portion, and said base portion includes an aperture formed therein, said aperture having a diameter substantially the same as the diameter of said pot engaging portion;

a hollow spool support shaft having an integral traverse bottom flange thereon which rests on said base portion of said pot above and spaced from said spindle;

at least one spool mounted on said hollow spool support shaft;

a hollow pipe centrally located on said rotatable spindle for feeding thread from said at least one spool through said hollow spool shaft and said rotatable spindle to emerge outside said pot in ballooning fashion as said spindle rotates;

a balloon ring surrounding said pot to control the degree of ballooning of said thread;

said rotatable spindle being selectively driven by a drive belt directly engaged with said integral drive pulley portion of said rotatable spindle;

magnetic means for preventing rotation of said pot and the at least one spool; wherein said magnetic means includes a magnetic belt, at least one magnet mounted on said magnet belt, wherein said magnetic means is located in said interior region, and said magnet belt engages said base portion of said pot, and at least one stationary external bracket means supporting at least one magnet outside of said pot at a location spaced from said pot enabling attractive interaction of said at least one magnet outside of said pot with said at lease one magnet located in said interior region of said pot, whereby said pot and said at least one spool remain stationary during rotation of said spindle.

2. A magnetic pot stabilizer as in claim 1, said magnet belt comprising:

a generally planar belt having a circular configuration, said belt resting on an interior bottom surface of said base portion of said pot and having a central circular opening to enable said rotatable spindle to extend into said base portion; and an extended portion partially surrounding said circular configuration of said generally planar belt, said extended portion carrying spaced pins extending into a circular trough disposed in the interior bottom surface of said base portion around the perimeter of said interior bottom surface;

said at least one magnet in the base portion of said pot being located in said trough between two of said spaced pins.

3. A magnetic pot stabilizer as in claim 2, said at least one bracket means comprising:

at least one L-shaped bracket adjustably mounted on a surface outside of said pot;

said at least one L-shaped bracket adjustably carrying a magnet holder having said at least one magnet outside of said pot mounted in said magnet holder, said magnet holder being spaced from said pot a distance sufficient to enable said thread emerging from said pot to pass between said magnet holder and said pot while said at least one magnet inside of said pot interacts with said at least one magnet in said magnet holder to prevent said pot from rotating with said rotatable spindle.

4. A magnet pot stabilizer as in claim 3, there being a plurality of magnets located within said pot by said magnet belt, a second plurality of magnets supported by said at least one bracket means, and at least a second bracket means circumferentially spaced around said pot from said at least one bracket means and supporting a third plurality of magnets.

5. A magnetic pot stabilizer as in claim 4, said rotatable spindle carrying said centrally located hollow pipe.

6. A magnetic pot stabilizer as in claim 3, said rotatable spindle carrying said centrally located hollow pipe.

7. A magnetic pot stabilizer as in claim 2, there being a plurality of magnets located within said pot by said magnet belt, a second plurality of magnets supported by said at least one bracket means, and at least a second bracket means circumferentially spaced around said pot from said at least one bracket means and supporting a third plurality of magnets.

8. A magnetic pot stabilizer as in claim 7, said rotatable spindle carrying said centrally located hollow pipe.

9. A magnetic pot stabilizer as in claim 2, said rotatable spindle carrying said centrally located hollow pipe.

10. A magnetic pot stabilizer as in claim 1, said at least one bracket means comprising:

at least one L-shaped bracket adjustably mounted on a surface outside of said pot;

said at least one L-shaped bracket adjustably carrying a magnet holder having said at least one magnet outside of said pot mounted in said magnet holder, said magnet holder being spaced from said pot a distance sufficient to enable said thread emerging from said pot to pass between said magnet holder and said pot while said at least one magnet inside of said pot interacts with said at least one magnet in said magnet holder to prevent said pot from rotating with said rotatable spindle.

11. A magnetic pot stabilizer as in claim 10, there being a plurality of magnets located within said pot by said magnet belt, a second plurality of magnets supported by said at least one bracket means, and at least a second bracket means circumferentially spaced around said pot from said at least one bracket means and supporting a third plurality of magnets.

12. A magnetic pot stabilizer as in claim 11, said rotatable spindle carrying said centrally located hollow pipe.

13. A magnetic pot stabilizer as in claim 10, said rotatable spindle carrying said centrally located hollow pipe.

14. A magnetic pot stabilizer as in claim 1, there being a plurality of magnetic located within said pot by said magnet belt, a second plurality of magnets supported by said at least one bracket means, and at least a second bracket means circumferentially spaced around said pot from said at least one bracket means and supporting a third plurality of magnets.

15. A magnetic pot stabilizer as in claim 14, said rotatable spindle carrying said centrally located hollow pipe.

16. A magnetic pot stabilizer as in claim 1, said rotatable spindle carrying said centrally located hollow pipe.

* * * * *